US005142999A

United States Patent [19]

Etemad et al.

[11] Patent Number: 5,142,999

[45] Date of Patent: Sep. 1, 1992

[54] INCINERATOR WITH FLUID-COOLED HEARTH

[75] Inventors: Mehran Etemad, Berwyn; Farshad Tavassoli, Norristown; William E. Marceau, Sagertown, all of Pa.

[73] Assignee: Axxon Corporation, Blue Bell, Pa.

[21] Appl. No.: 702,008

[22] Filed: May 17, 1991

[51] Int. Cl.[5] ..... B09B 3/00; F23D 14/00

[52] U.S. Cl. ..... 110/235; 110/336; 432/238

[58] Field of Search ..... 110/235, 336; 126/500, 126/513, 514; 432/238, 83

[56] References Cited

U.S. PATENT DOCUMENTS

| | | | |
|---|---|---|---|
| 3,869,994 | 3/1975 | Von Berlichingen | 110/235 |
| 4,221,922 | 9/1980 | Okimune | 110/336 X |
| 4,261,323 | 4/1981 | Horwinski | 126/513 X |
| 4,264,300 | 4/1981 | Gusev et al. | 432/238 X |
| 4,426,994 | 1/1984 | Burger et al. | 126/513 X |

*Primary Examiner*—Edward G. Favors

*Attorney, Agent, or Firm*—William H. Eilberg

[57] ABSTRACT

An incinerator hearth includes a bottom formed of a refractory slab. The slab has a plurality of upwardly-extending projections which define a serpentine channel. A conduit is placed within the channel. The conduit is made of steel or another material capable of withstanding high temperatures. The height of the conduit is slightly lower than the height of the projections. The upper surface of the conduit and the upper surfaces of the projections together define the combustion surface of the hearth. A heat transfer fluid is pumped through the conduit, and this fluid prevents the combustion surface of the hearth from becoming too hot. Thus, slag formed in the hearth tends not to adhere to the combustion surface, and can be easily removed without damaging that surface and without requiring that the incinerator be cooled down and manually cleaned. A control system regulates the temperature of the fluid by directing a variable proportion of the heat transfer fluid through a heat exchanger, in response to the sensed temperature of the liquid.

24 Claims, 7 Drawing Sheets

HEARTH WATER SCHEMATIC

INCINERATOR WITH FLUID-COOLED HEARTH

BACKGROUND OF THE INVENTION

This invention relates to the field of incinerators. In particular, the invention provides a hearth structure which lasts longer and requires considerably less maintenance than the incinerator hearths of the prior art.

A major problem with incinerators is the formation of slags. When certain waste materials are burned at high temperatures, the non-combustible products include both ash and slag formers. As used herein, the term "slag" refers to a product which takes the form of a solid mass, in contrast to ash which has a more powdery texture. Glass and metals tend to produce slags and, when molten, they tend to dissolve ash material and wet the refractory lining of the incinerator. Upon cooling, they solidify into a hardened mass.

The slag formed from glass and metals burned in an incinerator tends to adhere tightly to the refractory combustion surface of the hearth. After repeated use, wherein the incinerator has undergone many cycles of heating and cooling, a large quantity of slag will have accumulated on the combustion surface. Eventually, the pile of slag becomes so large that it seriously degrades the performance of the incinerator, by occupying space that should be occupied by fresh waste, by absorbing heat that is intended to be transmitted to the waste itself, and also by obstructing the combustion surface and thereby making it more difficult to remove the non-combustible products.

As noted above, slag adheres tightly to the refractory lining of the hearth. This adherence results from the fact that slag is a good solvent for refractory materials. Thus, it is very difficult to remove the slag without also removing part of the refractory lining. In typical conventional incinerators, one uses a "plow" or piston that periodically pushes the combustion products along the bottom of the hearth and out of the hearth. If slag has adhered to the bottom of the hearth, the plow may not be able to remove all of the slag. Moreover, the slag that is removed will carry away pieces of the refractory lining.

When an unacceptably large amount of slag has accumulated, the only known way to remove it has been to deactivate the incinerator until it is cool enough to allow workers to enter the hearth. The workers then remove the slag manually, by chipping it away. This procedure is extremely costly, not so much because of the labor required, but mainly because of the length of time during which the incinerator must be idled. Because the incinerator operates at very high temperatures, it requires a long time to cool. The bulk temperature inside the hearth is typically about 1400°-1900° F., and the temperature at the center of combustion can be in the range of about 2200°-3000° F. Thus, it is usually necessary to wait two or three days before the hearth is cool enough for workers to enter. Meanwhile, the user must find alternative means for disposing of waste. The losses due to "down time" can therefore be very large.

Eventually, removal of slag from the bottom of the hearth will damage the refractory lining so much that the lining must be replaced. Replacement of the lining is expensive, not only because of the labor and materials needed, but also because of the "down time" of the incinerator.

The problems described above are particularly acute when the waste being incinerated contains a large amount of glass. Molten glass is especially likely to form slag. While it is possible to prevent the molten glass from adhering to the hearth bottom by reducing the temperature of the hearth, this approach is not satisfactory in general, because the lower the temperature, the less efficient the combustion. If the temperature of the hearth is too low, then materials such as plastics, among the waste products intended to be incinerated, may solidify on the bottom of the hearth, instead of being burned.

The present invention provides an incinerator which solves the problems described above. In the incinerator of the present invention, slag is less likely to accumulate, and therefore the "down time" of the unit is minimized, while the useful life of the refractory lining is prolonged.

SUMMARY OF THE INVENTION

The incinerator hearth of the present invention includes a refractory bottom surface made from a slab which has a plurality of upwardly-extending integral projections. The projections define a serpentine channel. A conduit is located within the channel, and fills substantially all of the space created by the channel. The channel and the conduit traverse substantially the entire area of the bottom of hearth. The height of the conduit is slightly lower than the height of the channel. The upper surface of the conduit and the upper surfaces of the projections together define the combustion surface of the hearth. The conduit is preferably made of a steel tube, and is connected to a source of fluid.

Fluid is pumped through the conduit, and absorbs heat from the refractory material. Since the conduit defines part of the combustion surface of the hearth, and since the conduit is cooled by the fluid, the effective temperature of the combustion surface is limited.

The temperature of the fluid is regulated by a thermostatically controlled valve which recirculates fluid from the outlet of the hearth back to the hearth inlet. The valve is configured to direct a first portion of the fluid from the hearth outlet to a heat exchanger, while the remaining second portion of the fluid passes essentially directly back to the hearth inlet. The valve controls the relative sizes of these first and second portions, in response to the sensed fluid temperature at the outlet of the valve, thereby controlling the temperature of the fluid in the hearth, and thus controlling the temperature of the combustion surface.

The conduit is affixed to a base plate by a plurality of bolts. Also, the conduit is attached to the slab with a breakable cement having a relatively high thermal conductivity. The cement therefore facilitates the transfer of heat from the refractory slab to the conduit, but still allows the conduit to be removed from the hearth bottom, with relative ease, when maintenance is required.

It is therefore an object of the invention to provide an incinerator having a fluid-cooled hearth.

It is another object to prolong the useful life of the refractory lining of an incinerator hearth.

It is another object to reduce the amount of "down time" experienced in operating an incinerator hearth.

It is another object to improve the efficiency of operation of an incinerator by minimizing the amount of slag accumulated therein.

It is another object to provide a fluid-cooled incinerator hearth, wherein the temperature of the cooling fluid can be accurately regulated.

It is another object to provide a fluid-cooled incinerator hearth having a fluid conduit which can be removed relatively easily when maintenance is required.

Other objects and advantages of the invention will be apparent to those skilled in the art, from a reading of the following brief description of the drawings, the detailed description of the invention, and the appended claims.

DETAILED DESCRIPTION OF THE INVENTION

Figure 1:
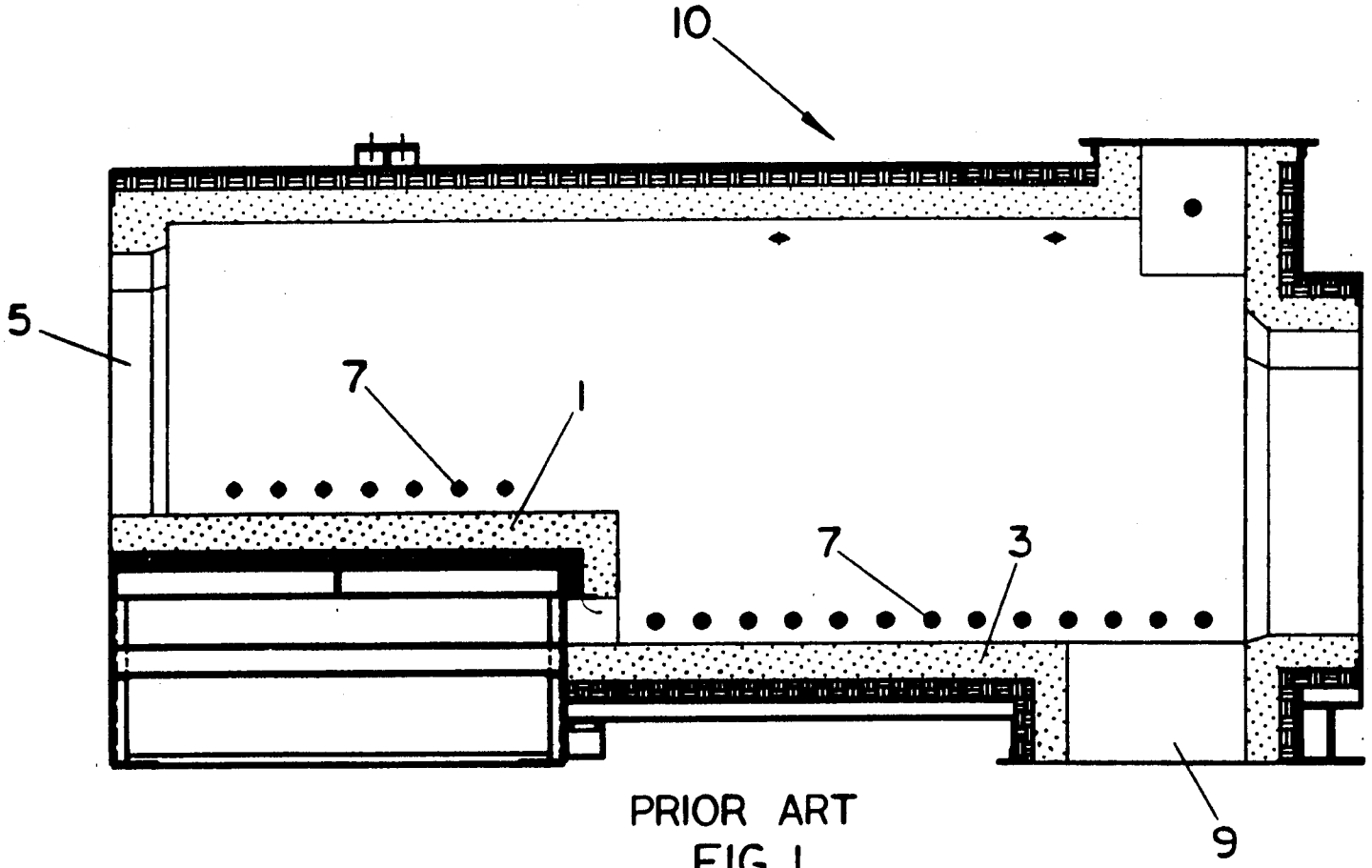
PRIOR ART FIG. 1
FIG. 1 is a cross-sectional view of a conventional hearth used in an incinerator.

Before describing the present invention, it is helpful to describe briefly the structure of a conventional incinerator hearth. FIG. 1 shows a conventional hearth, which can also be used with the present invention. The hearth has two combustion surfaces, namely an upper surface 1 and lower surface 3. The two surfaces define a "step". The waste to be incinerated is introduced through inlet end 5, by a suitable piston or other means (not shown). The waste is first burned on the upper surface 1, which is made of a refractory material. Periodically, additional waste is added to the combustion chamber. New waste displaces the waste material already on the combustion surface. The introduction of more waste eventually causes the material in the hearth to fall from upper surface 1 to lower surface 3. As the waste falls, it tumbles randomly, and this tumbling creates a "stoking" effect, making the combustion more uniform, and increasing the overall combustion rate of the incinerator.

In a typical incinerator, a new batch of waste is introduced approximately every eight minutes, and each batch of waste pushes the previous batch to the right, as shown in FIG. 1. Eventually, the waste is burned, and the remaining ash is removed from lower surface 3 by an ash plow (not shown) which pushes the ash to the vicinity of outlet opening 9. Air holes 7 provide air for combustion. The combustion occurs on both of surfaces 1 and 3.

As stated above, a major problem encountered with incinerator hearths is the formation of slag. It is known that it is possible to reduce the formation of slag by reducing the temperature of the combustion surfaces. According to the present invention, this reduction is accomplished without appreciably reducing the combustion temperature by pumping a heat transfer fluid through tubes which define part of the combustion surface, in a manner to be described. According to the present invention, the combustion surface is kept sufficiently cool so that slag does not form, yet sufficiently hot to support complete combustion of the waste.

Figure 2:
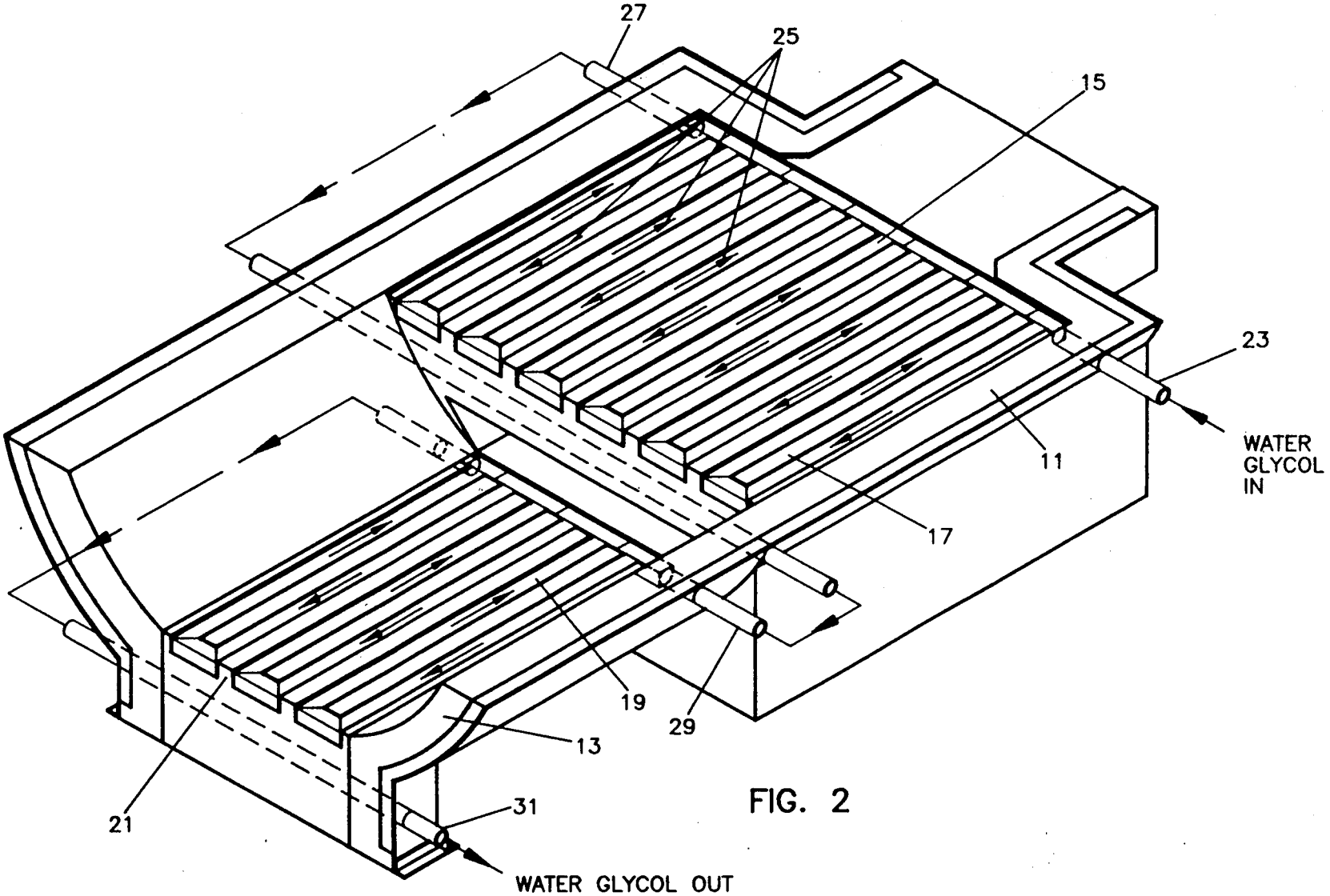
FIG. 2 is a perspective view of a portion the incinerator hearth of the present invention, showing the fluid-carrying tubes set in a refractory block.

The structure of the hearth made according to the present invention is illustrated in FIGS. 2–7. FIG. 2 is a perspective view showing the basic arrangement of the combustion surfaces. For the sake of clarity of illustration, FIG. 2 shows only the combustion surfaces and the structural members which support these surfaces.

The hearth of FIG. 2 includes upper combustion surface 11 and lower combustion surface 13. The upper surface includes serpentine tube 15 which is set in a serpentine channel defined by a slab of refractory material 17. The lower combustion surface likewise includes serpentine tube 19, also set in a channel defined by a similar refractory slab 21. Thus, the upper surfaces of the tubes 15 and 19, together with the portions of the slabs located between the tubes, define the combustion surfaces 11 and 13, respectively.

A heat transfer fluid, which is preferably a liquid, such as a water-based glycol solution, is pumped into tube 15 through inlet pipe 23. The solution travels through the tube, thus following the serpentine path, as indicated by arrows 25. The solution exits the tube 15 through outlet pipe 27. The outlet pipe is connected to another inlet pipe 29 which conveys liquid into tube 19. Liquid exits tube 19 through pipe 31.

Figure 3:
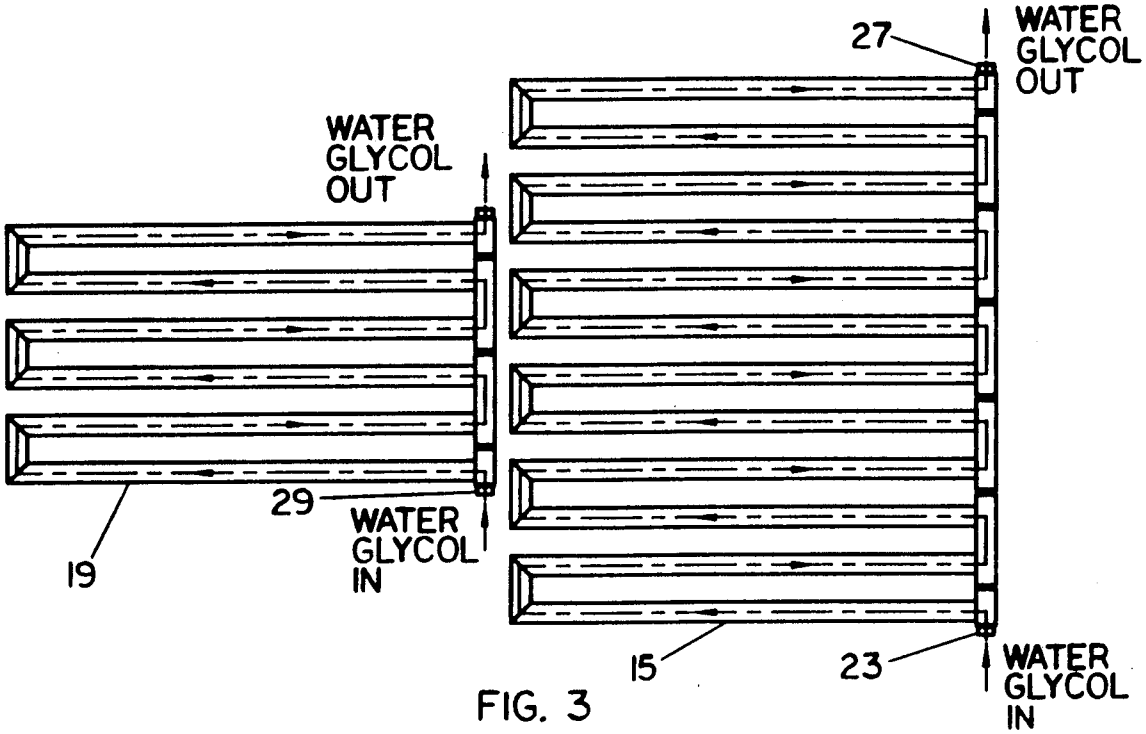
FIG. 3 is a plan view of the fluid-carrying tubes of the incinerator of the present invention.
Figure 4:
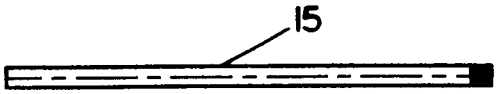
FIG. 4 is a side elevational view of the structure shown in FIG. 3.
Figure 4:
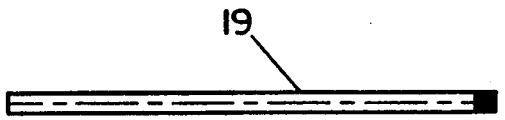

FIGS. 3 and 4 provide a simplified illustration of the serpentine path of the liquid flowing through tubes 15 and 19. The use of similar reference numerals means that the components are identical to those described earlier. The liquid flows in one single circuit, traversing the entire length of the conduits, from the inlet pipe 23 through outlet pipe 31.

Figure 5:
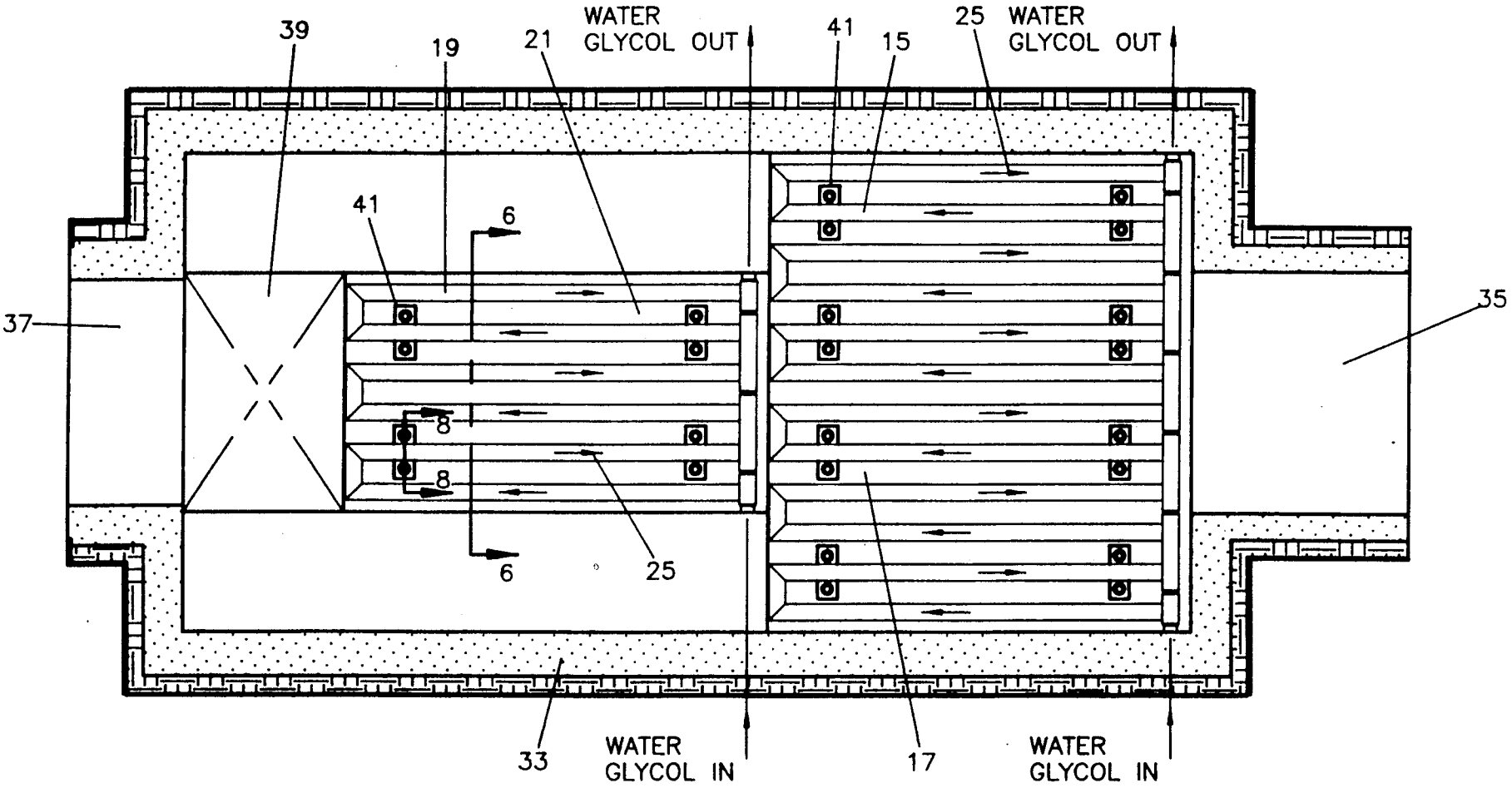
FIG. 5 is a plan view, partly in cross-section, of the incinerator hearth of the present invention.

FIG. 5 is a plan view showing the tubes of the present invention installed within the shell 33 of an incinerator hearth. Tube 15 is disposed near inlet end 35 and tube 19 is located near outlet end 37. The consumed ash in the hearth can be pushed into discharge region 39 and removed. The manner of discharging material from the hearth is not part of the present invention; such material can be discharged in any conventional manner.

Figure 6:
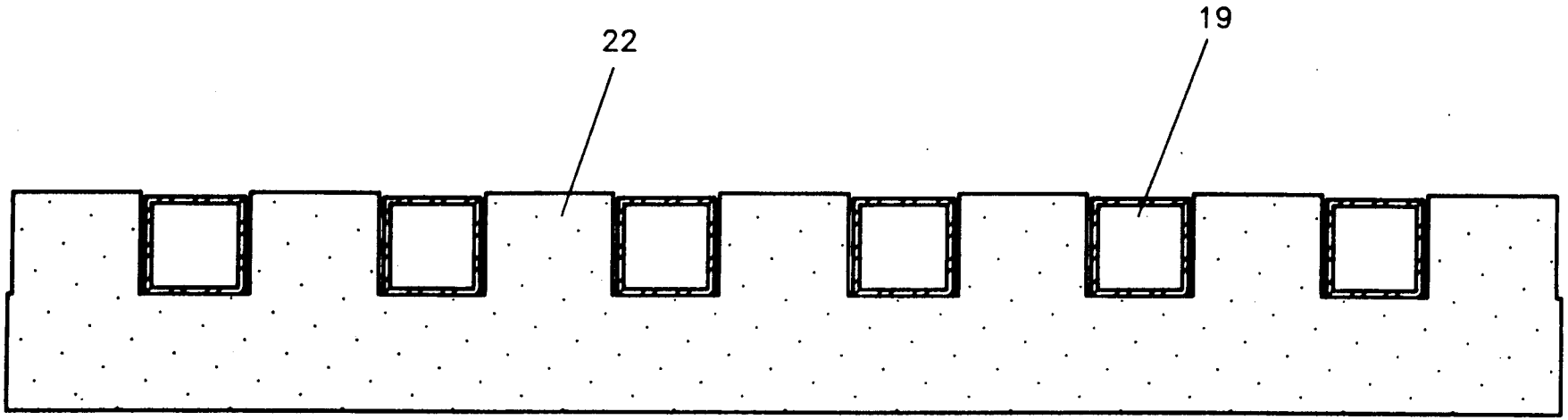
FIG. 6 is a cross-sectional view of the lower combustion surface of the hearth, taken along the line 6—6 of FIG. 5.

FIG. 6 is a cross-sectional view of the lower combustion surface shown in FIG. 5. FIG. 6 more clearly shows the structure of refractory slab 21. Slab 21 defines integral upwardly-extending projections 22 which are integral with the slab. These projections define the serpentine channel which receives the tube 19. It is the upper surfaces of these projections which, together with the upper surface of the tube, define the combustion surface of the hearth.

In the preferred embodiment, the height of the tube is slightly less than the height of the channel. Thus, the hearth bottom is not perfectly smooth, but instead has shallow recesses at the locations of the tube.

The reason for making the tube slightly shorter than the channel is as follows. While cooling the tube is advantageous in that it prevents the formation of slag, cooling the tube also has the potential disadvantage of preventing complete combustion. The recess ameliorates the latter problem, because a layer of ash forms in the recess, covering the top surface of the tube. This ash layer comprises an insulating layer between the tube and the interior of the hearth. Thus, while the tube remains sufficiently cool to prevent slag formation, it does not extract so much heat from the hearth as to prevent complete combustion above the ash layer. The shape of the recess prevents the ash from being swept away by the ash plow (not shown) which is periodically moved across the hearth bottom. Since the plow sweeps ash at the level of the top of the projections, it therefore leaves undisturbed the ash in the recesses, covering the tube.

In one example, where the height of the channel is about 2.25 inches, the height of the tube can be about 0.25 inches lower than the height of the channel. However, the invention should not be deemed limited by the latter dimensions, which are given only as an example. In general, the height of the recesses should be approximately 10–15% of the height of the channel. The latter figures are not absolute limits, and also should not be deemed to limit the invention. In general, if the recesses are too deep, the ash layer will be too thick, and the cooling due to the tube will be insufficient. On the other hand, if the recesses are too shallow, the combustion above the tube may be incomplete.

FIG. 6 would be essentially the same if the cross-section had been taken across the upper combustion surface instead of the lower surface, except that the cross-section would show slab 17 and tube 15.

Figure 7:
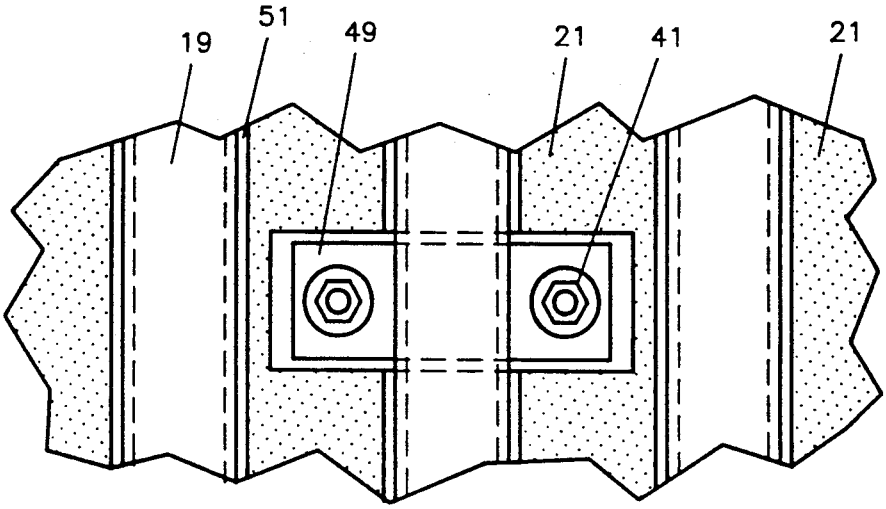
FIG. 7 is a top view of a pair of bolts used to attach the tubes of the present invention to a base plate.
Figure 8:
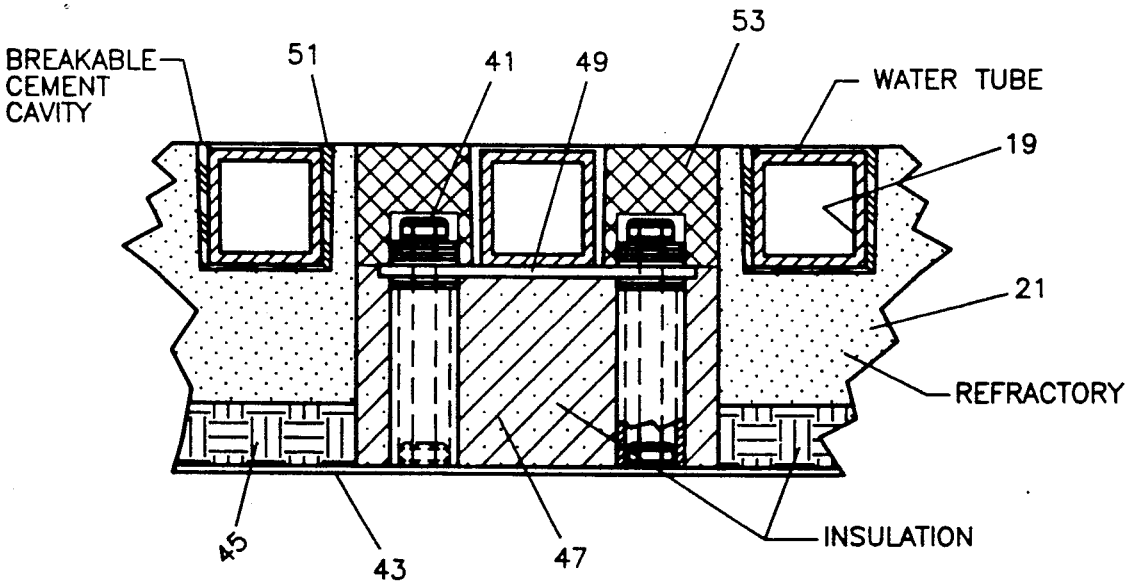
FIG. 8 is a fragmentary cross-sectional view of the bolts, taken along the line 8—8 of FIG. 5.

FIGS. 5, 7, and 8 provide more details of the construction of the incinerator hearth of the present invention. These figures show bolts 41 which hold the tubes in place. As shown most clearly in FIG. 8, tube 19 rests within a channel defined by refractory slab 21. Slab 21 rests on hard insulation material 45. The latter material is preferably mineral wool which has been compressed into a board. The bolts themselves are located within a cavity filled with soft insulation 47. The latter material is preferably a blanket of mineral wool, or other ceramic fiber or other material capable of withstanding high temperatures.

Each pair of bolts holds a support plate 49 which supports a portion of tube 19. The bolts attach the tubes 15 and 19 to base plate 43, which can be a quarter-inch steel plate, or equivalent. The bolts are necessary because the plows used to move ash over the surfaces of the tubes are operated by very powerful cylinders which could displace the tubes if they are not firmly affixed. Bolts are preferable to other means of attachment because they facilitate removal of the tubes when repair is necessary.

The channel in which the tube rests includes a cavity lined with breakable cement 51. The breakable cement is preferably an ordinary cement but without the usual binders. It should have a relatively high thermal conductivity and relatively low adherence. Thus, the cement conducts heat from the adjacent refractory material to the steel tubes. But because the cement can be relatively easily broken, it is easy to remove the tubes for repair.

The above discussion of the structure of tube 19, and the other components associated with the lower combustion surface, applies equally for the upper combustion surface and tube 15.

In building the incinerator hearth of the present invention, the channels to be occupied by the serpentine tubes comprise forms for the pouring of the refractory slab, which can be concrete or other pourable material. The refractory material fills all of the spaces, except the space occupied by the tubes, the space occupied by hard insulation material 45, and the areas in the immediate region of the bolts.

After the slab has been poured, and the bolts and conduit installed, the regions above the bolts are lined with plastic bags, or the like, and the bags are filled with more of the same concrete used to form the slab. Thus, the bolts become covered with refractory blocks 53. When the incinerator is operating, the plastic bags vaporize, leaving the refractory blocks 53 which fill virtually the entire space above the bolts. In practice, the blocks may comprise cubes having a side as small as about two inches. Due to the manner of formation of the blocks, described above, there is minimal clearance between the blocks and the surrounding refractory. Thus, the combustion surface remains essentially unbroken, as illustrated in FIG. 8. Because they were not poured together with the remainder of the refractory slab, the blocks are relatively easy to remove when it is necessary to gain access to the bolts. Note that the slab and the tubes together define virtually the entirety of the hearth bottom, i.e. the combustion surface.

The tubes are preferably made of steel, such as ASTM A-36. Other types of structural steel could be used, and the invention is not limited to a particular material.

The liquid flowing through the tubes is preferably glycol, in a water-based solution. It is not desirable to use ordinary water as the heat transfer medium, because water will quickly vaporize into steam, because of the elevated temperatures in the hearth unless the system is maintained under a pressure of at least 55 psig. The heat transfer medium should be a liquid having a relatively high boiling point, e.g. about 300° F.

Figure 9:
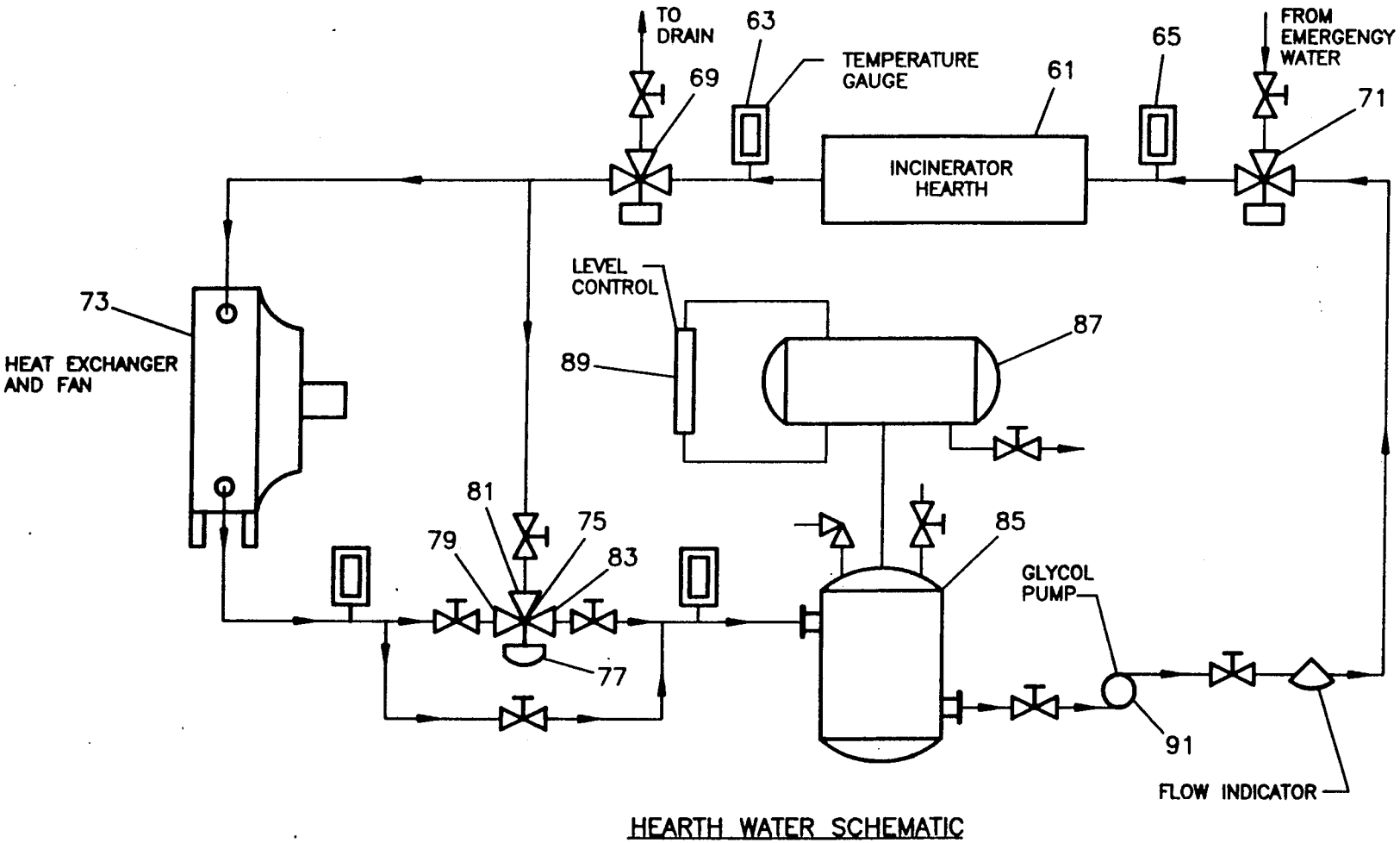
FIG. 9 is a schematic diagram of the system used for controlling the temperature of the fluid flowing through the tubes of the present invention.

FIG. 9 is a schematic diagram of the control system for regulating the temperature of the heat transfer liquid. Regulation of the temperature is important because, as stated above, it is necessary that the combustion surface be cool enough to prevent formation of slag, yet hot enough to support complete combustion.

In FIG. 9, the incinerator hearth is represented by block 61. Temperature sensors 63 and 65 are located at either side of the hearth, to sense the temperature of the liquid in the conduit at the inlet and outlet ends of the hearth. Three-way valves 69 and 71 are also located on either side of the hearth. These three-way valves provide a safety mechanism in the event of a power failure in the control system, which would disable the pumps and the heat exchanger. In their normal state, the valves are spring-biased so that they conduct water (which can be ordinary tap water) from an emergency source, through valve 71, through the liquid conduit in the hearth, through valve 69, and to a drain. Thus, if there is a power failure in the control system, there will always be liquid flowing through the conduit which passes through the hearth, and the hearth temperature cannot become dangerously high. If the temperature were allowed to rise without limit, the liquid in the tubes would eventually boil, increasing the internal pressure and creating a hazardous condition. When the control system is operating normally, the positions of the three-way valves are changed by suitable means, such as solenoids, so that the source and drain for the emergency liquid are disconnected, and so that liquid is recirculated through the hearth as described below.

Assume now that the control system is operating normally, and that valves 69 and 71 are switched to disconnect the emergency water supply. Liquid passing from the hearth through valve 69 can flow either to heat exchanger 73 or control valve 75. The control valve includes three ports which, for the sake of convenience, will be called the left port 79, the top port 81, and the right port 83. The right port is the outlet port and the other ports should be considered the inlet ports. The control valve also includes thermostat 77 which opens or closes the left and top ports in response to the sensed temperature at the outlet of the valve. The control valve is constructed so that the size of the openings of the left and top ports are continuously variable. If the temperature of the liquid at the outlet port of the valve is too high, say, greater than 230° F., the thermostat constricts the top port and opens the left port, so that liquid leaving the valve is mostly liquid which has passed through heat exchanger 73 (and which is therefore cooled). If the temperature of the liquid at the outlet port is too low, the thermostat constricts the left port and opens the top port, so that most of the liquid leaving the valve comes directly from the hearth and not from the heat exchanger. The latter valve setting will increase the temperature of the liquid flowing back to the hearth.

The control valve passes a continuously variable mixture of liquid from the left and top ports. The greater the proportion of liquid taken from the left port, the lesser the proportion taken from the top port, and vice versa. The structure of the control valve does not form a part of the invention, as this type of valve is commercially available.

In the normal and preferred mode of operation, the liquid should enter the hearth at about 230° F. and should leave at about 300° F.

The liquid leaving the control valve passes through an air separator 85 which removes air bubbles that may have entered the system if the emergency water system was in use. An expansion tank 87 provides a source of stored liquid which compensates for leaks in the system. A level controller 89 is also provided. Pump 91 maintains the flow of liquid through the system. The liquid flows generally counterclockwise, as shown in FIG. 9.

The invention can be modified in many ways. For example, although the "stepped" combustion surfaces, shown in FIG. 1, is preferred, it is not absolutely necessary. The entire combustion surface of the hearth can be located in one plane.

Also, in the embodiment shown above, there is exactly one liquid circuit. That is, the same liquid travels through one serpentine path, traversing substantially the entire hearth surface. It is also possible to subdivide the combustion surface into two or more regions, and to provide a separate liquid circuit, and a separate temperature regulating system, for each such region.

The shape of the serpentine channel can also be modified. Other shapes, such as spirals, could be used instead of the "zig-zag" shape of the channel, for example. The height of the recesses above the tube can be varied, according to the general guidelines noted above.

Other modifications to the invention can be made, as will be apparent to those skilled in the art. All such modifications should be deemed within the spirit and scope of the following claims.

What is claimed is:

1. In an incinerator, the incinerator including a combustion hearth, the hearth having a combustion surface, the improvement wherein the combustion surface of the hearth comprises a refractory material which is formed as a slab with a plurality of upwardly-extending projections integrally formed with the slab, the projections defining a serpentine channel, and conduit means disposed within said channel, the conduit means occupying most of the channel, the conduit means including means for introducing a fluid into the conduit means.

2. The improvement of claim 1, wherein the conduit means is adhered to the projections with a breakable cement, the cement being capable of conducting heat from the projections to the conduit means.

3. The improvement of claim 1, wherein the introducing means is connected to a source of fluid, and wherein the improvement further comprises means for regulating the temperature of the fluid.

4. The improvement of claim 3, wherein the regulating means comprises a thermostatically controlled valve, the valve comprising means for receiving fluid from the conduit means, means for directing fluid back to the hearth, and means for sensing the temperature of the fluid passing through the valve, the valve comprising means for directing a first portion of the fluid leaving the hearth through a heat exchanger, and for directing a second portion of the fluid leaving the hearth back to the hearth, wherein the valve includes means for controlling the relative sizes of said first and second portions in response to the sensed temperature of the fluid passing through the valve.

5. The improvement of claim 1, wherein the hearth is mounted over a base plate, and wherein the conduit means is affixed to the base plate by a plurality of bolts.

6. The improvement of claim 5, wherein the bolts are located n cavities in the combustion surface, the cavities being partly filled with an insulating materials, the cavities also containing refractory blocks which define the combustion surface in the region of the cavities.

7. The improvement of claim 1, wherein at least a portion of the slab is disposed over a hard insulating material.

8. The improvement of claim 1, wherein the conduit means has a height which is less than the height of the channel, the conduit means and channel defining a recess above the conduit means, wherein the height of the recess is approximately 10–15% of the height of the channel.

9. An incinerator hearth, the hearth comprising a refractory slab which has a plurality of upwardly-extending projections, the projections defining a channel, wherein there is a single conduit disposed within the channel, the conduit comprising a path for fluid, wherein the conduit and the projections together define a combustion surface for the hearth, and wherein the conduit extends over most of said combustion surface.

10. The incinerator hearth of claim 9, wherein the height of the conduit is slightly lower than the height of the channel.

11. The incinerator hearth of claim 9, wherein at least a portion of the slab is disposed over a hard insulating material.

12. A method of operating an incinerator hearth, the hearth having a combustion surface, the method comprising the steps of passing a heat transfer fluid through a tube formed in the combustion surface, and regulating the temperature of the fluid.

13. The method of claim 12, wherein the tube has a serpentine shape, wherein the fluid travels along a serpentine path along the combustion surface.

14. The method of claim 13, wherein the hearth includes a refractory slab having upwardly-extending projections which define a serpentine channel, the tube being formed in said channel, wherein the combustion surface is defined the projections and the tube.

15. In an incinerator hearth, the hearth having a combustion surface, the improvement comprising a single fluid conduit disposed within the combustion surface, the conduit extending over most of the combustion surface, the conduit having an upper surface which defines at least a portion of the combustion surface.

16. The improvement of claim 15, wherein the combustion surface includes the conduit and a refractory material, and wherein the conduit is recessed below the level of the refractory material.

17. An incinerator hearth, the hearth comprising a refractory slab which has a plurality of upwardly-extending projections, the projections defining a channel, wherein there is a conduit disposed within the channel, the conduit comprising a path for fluid, wherein the conduit and the projections together define a combustion surface for the hearth, wherein the channel has a serpentine shape, and wherein the conduit has a serpentine shape.

18. An incinerator hearth, the hearth comprising a refractory slab which has a plurality of upwardly-extending projections, the projections defining a channel, wherein there is a conduit disposed within the channel, the conduit comprising a path for fluid, wherein the conduit and the projections together define a combustion surface for the hearth, wherein the conduit is adhered to the projections with a breakable cement, the cement being capable of conducting heat from the projections to the conduit.

19. An incinerator hearth, the heart comprising a refractory slab which has a plurality of upwardly-extending projections, the projections defining a channel, wherein there is a conduit disposed within the channel, the conduit comprising a path for fluid, wherein the conduit and the projections together define a combustion surface for the hearth, wherein the conduit includes an inlet end and an outlet end, the hearth further comprising means for introducing fluid into the inlet end and withdrawing fluid from the outlet end, and means for regulating the temperature of said fluid.

20. An incinerator hearth, the hearth comprising a refractory slab which has a plurality of upwardly-extending projections, the projections defining a channel, wherein there is a conduit disposed within the channel, the conduit comprising a path for fluid, wherein the conduit and the projections together define a combustion surface for the hearth, wherein the hearth is mounted over a base plate, and wherein the conduit is affixed to the base plate by a plurality of bolts.

21. An incinerator hearth, the hearth comprising a refractory slab which has a plurality of upwardly-extending projections, the projections defining a channel, wherein there is a conduit disposed within the channel, the conduit comprising a path for fluid, wherein the conduit and the projections together define a combustion surface for the hearth, wherein the conduit has a height which is less than the height of the projections, the conduit and projections defining a recess above the conduit, wherein the height of the recess is approximately 10–15% of the height of the projections.

22. In an incinerator hearth, the hearth having a combustion surface, the improvement comprising a fluid conduit disposed within the combustion surface, the conduit extending over a portion of the combustion surface, the conduit having an upper surface which defines at least a portion of the combustion surface, further comprising means for passing a fluid through the conduit, and means for regulating the temperature of the fluid entering the conduit.

23. The incinerator hearth of claim 19, wherein the regulating means comprises a thermostatically controlled valve, the valve comprising means for receiving fluid from the outlet end of the conduit, means for directing fluid back to the inlet end of the conduit, and means for sensing the temperature of the fluid passing through the valve, the valve comprising means for directing a first portion of the fluid leaving the hearth through a heat exchanger, and for directing a second portion of the fluid leaving the hearth back to the hearth, wherein the valve includes means for controlling the relative sizes of said first and second portions in response to the sensed temperature of the fluid passing through the valve.

24. The incinerator hearth of claim 20, wherein the bolts are located in cavities in the combustion surface, the cavities being partly filled with an insulating materials, the cavities also containing refractory blocks which define the combustion surface in the region of the cavities.

* * * * *